US009758897B2

(12) United States Patent
Wilson et al.

(10) Patent No.: US 9,758,897 B2
(45) Date of Patent: Sep. 12, 2017

(54) ELECTROPLATING APPARATUS WITH NOTCH ADAPTED CONTACT RING SEAL AND THIEF ELECTRODE

(71) Applicant: APPLIED Materials, Inc., Santa Clara, CA (US)

(72) Inventors: Gregory J. Wilson, Kalispell, MT (US); Paul R. McHugh, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 337 days.

(21) Appl. No.: 14/606,775

(22) Filed: Jan. 27, 2015

(65) Prior Publication Data

US 2016/0215409 A1 Jul. 28, 2016

(51) Int. Cl.

| | |
|---|---|
| ***C25D 7/12*** | (2006.01) |
| ***C25D 17/06*** | (2006.01) |
| ***C25D 21/12*** | (2006.01) |
| ***C25D 17/00*** | (2006.01) |

(52) U.S. Cl.

CPC ..... *C25D 17/005* (2013.01); *C25D 7/12* (2013.01); *C25D 17/001* (2013.01); *C25D 17/004* (2013.01); *C25D 17/007* (2013.01); *C25D 21/12* (2013.01)

(58) Field of Classification Search

CPC .... C25D 21/12; C25D 17/001; C25D 17/004; C25D 17/005

See application file for complete search history.

(56) References Cited

U.S. PATENT DOCUMENTS

| | | | | |
|---|---|---|---|---|
| 5,761,023 | A | 6/1998 | Lue et al. | |
| 6,228,231 | B1 | 5/2001 | Uzoh | |
| 7,985,325 | B2 | 7/2011 | Rash et al. | |
| 2002/0125140 | A1* | 9/2002 | Uzoh | C25D 21/12 205/82 |
| 2003/0085119 | A1 | 5/2003 | Davis et al. | |
| 2004/0000485 | A1* | 1/2004 | Preusse | C25D 21/12 205/83 |
| 2009/0107836 | A1 | 4/2009 | Rash et al. | |

(Continued)

FOREIGN PATENT DOCUMENTS

| | | |
|---|---|---|
| JP | 2007-009241 A | 1/2007 |
| JP | 2008-297586 A | 12/2008 |

OTHER PUBLICATIONS

Korean Intellectual Property Office, The International Search Report and the Written Opinion of the International Searching Authority issued in International application No. PCT/US2016/014164 (May 30, 2016).

*Primary Examiner* — Brian W Cohen

(74) *Attorney, Agent, or Firm* — Perkins Coie LLP; Kenneth H. Ohriner

(57) ABSTRACT

An electro-processing apparatus has a contact ring including a seal which is able to compensate for electric field distortions created by a notch (or other irregularity) on the wafer or work piece. The shape of the contact ring at the notch is changed, to reduce current crowding at the notch. The change in shape changes the resistance of the current path between a thief electrode and the wafer edge to increase thief electrode current drawn from the region of the notch. As a result, the wafer is plated with a film having more uniform thickness.

8 Claims, 6 Drawing Sheets

(56) References Cited

U.S. PATENT DOCUMENTS

| | | | | |
|---|---|---|---|---|
| 2012/0258408 | A1* | 10/2012 | Mayer | C25D 21/12 430/325 |
| 2013/0062197 | A1 | 3/2013 | He et al. | |
| 2013/0146447 | A1* | 6/2013 | Wilson | C25D 17/001 204/242 |
| 2013/0306465 | A1 | 11/2013 | Zimmerman et al. | |
| 2014/0144781 | A1 | 5/2014 | He | |
| 2014/0367264 | A1* | 12/2014 | Wilson | C25D 17/001 205/83 |

* cited by examiner

ELECTROPLATING APPARATUS WITH NOTCH ADAPTED CONTACT RING SEAL AND THIEF ELECTRODE

BACKGROUND OF THE INVENTION

Manufacture of semiconductor integrated circuits and other micro-scale devices typically requires formation of multiple metal layers on a wafer or other substrate. By electroplating metals layers in combination with other steps, such as planarizing, etching and photolithography, patterned metal layers forming the micro-scale devices are created.

Electroplating is performed with the substrate, or one side of the substrate, in a bath of liquid electrolyte, and with electrical contacts touching a conductive layer on the substrate surface. Electrical current is passed through the electrolyte and the conductive layer. Metal ions in the electrolyte deposit or plate out onto the substrate, creating a metal film on the substrate. The metal ions also tend to plate out onto the electrical contacts as well. This affect, referred to as "plate-up", changes the electric field around the contacts, causing non-uniform plating. The metal plated onto the electrical contacts consequently must be removed, adding to the time requirements and complexity of the manufacturing process.

So called dry or closed contact rings have been developed to avoid plate-up of the contacts. In these designs, a seal seals the electrolyte away from the electrical contacts. The seal contacts the substrate surface radially inwardly of the electrical contacts, so that the contacts remain isolated from the electrolyte. Industry specifications for plating with a sealed contact ring increasingly require that the annular band at the edge of the wafer covered by the seal must be as small as possible, currently towards about 1 mm. To plate wafers having a notch in the edge of the wafer (to indicate a specific crystal orientation of the wafer material), the seal correspondingly must have an inward protrusion at the notch to maintain a continuous seal against the wafer. During electroplating, electric current is crowded at the notch due to the irregular geometry. This causes the plated film to be thicker around the notch than at the rest of the wafer. The yield of the wafer may therefore be reduced since the thicker plated film around the notch may negatively affect subsequent processing steps.

Accordingly, engineering challenges remain in electroplating wafers and similar work pieces having edge irregularities, such as a notch.

SUMMARY OF THE INVENTION

Current crowding resulting in thicker plating in the region of the notch is reduced or eliminated by increasing the influence of a current thief electrode at the region of the notch. A recess may be provided in the contact ring, or in the seal of the contact ring, or both. The recess provides a larger flow path through the electrolyte from the region of the notch on the wafer to the current thief electrode, causing the current electrode thief to draw more current from the region of the notch, relative to the rest of the wafer.

In a first design, an electro-processing apparatus has a thief current electrode operating with a contact ring having a seal, to compensate for electric field distortions created by a notch (or other irregularity) on the wafer or work piece. The shape of the seal is changed to provide a localized area around the notch having a greater exposure to the thief electrode. The thief electrode consequently draws more current preferentially away from the region of the notch, improving plating uniformity. In a first aspect, a contact ring has a seal with a thin section at the notch. The shape of the seal at the notch is changed, relative to the rest of the seal, to reduce current crowding at the notch. The change in the shape of the seal at the notch reduces the resistance of current path between the thief electrode and the wafer edge to increase thief electrode current drawn from the region of the notch. As a result, the wafer is plated with a film having more uniform thickness.

DETAILED DESCRIPTION

Figure 5:
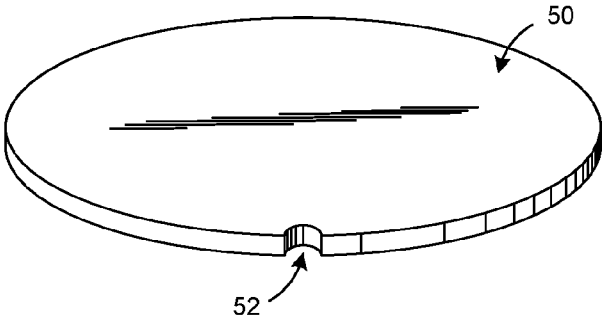
FIG. 5 (Prior Art)
FIG. 5 is a perspective schematic view of the wafer shown in FIG. 4.

To achieve a high yield of devices from each wafer, the edge zone which is contacted by the seal must be as small as possible. In the past, an edge zone of 2 or 3 mm (i.e., the annular ring at the wafer edge not useable for manufacturing devices) was often acceptable. With current industry requirements, the edge zone is now approaching or already at 1 mm. Referring momentarily to FIG. 5, some wafers 50 have a notch 52 (enlarged for illustration). On a 300 mm diameter wafer 50, the notch 52 extends in 1.5 mm. Therefore, the seal used for processing these types of wafers has an inward projection at the notch to avoid plating fluid leaking through the notch. The resulting seal covers more of the wafer around the notch. This changes the electric field in the region around the notch, causing the plated film around the notch to be thicker than the plated film on the rest of the wafer, due to current crowding at the notch.

One method to improve uniformity near the notch is to remove ring contact fingers at the notch. This is effective when the plated film is thin (<0.5 microns). For films greater than 0.5 microns thick, the notch region still plates preferentially when the fingers near the notch are removed. Because the wafer is rotating during plating, special shielding or geometry modifications to components of plating apparatus that do not rotate with the wafer are not practical.

The engineering challenges presented by the notch (or other edge irregularity) may be met with a seal having a flatted section at the notch. The shape of the seal at the notch is changed, relative to the rest of the seal, to reduce current crowding at the notch. The change in the seal shape changes the resistance or restriction of a thief electrode current between a thief electrode and the wafer edge. Thief electrode current is preferentially focused at the current crowding area near the notch and the film thickness uniformity is improved.

As an alternative or supplemental design feature for improving uniformity at the notch, a separate contact channel for the contact fingers in the flat region may be used. This channel can be driven to a slightly higher potential so that the plated film at the notch is more uniform with the rest of the wafer. In addition, a small external thief electrode may be imbedded in the external body of the seal near the flat. This external thief electrode may be controlled to the same potential as the rest of the ring and not require a separate power supply channel. The thieving region reduces the current crowding at the flat. The external thief electrode may be deplated during each ring maintenance step.

The techniques described above may be used for copper damascene plating with a sealed contact ring having a flat at the notch. They may also be used for wafer level packaging plating (WLP) if the electroplating apparatus has an edge thief electrode. In these applications, the seal shape at portions of the wafer circumference may be changed to allow more or less thieving in these regions. For example, while WLP wafers may not need a seal with a flat side because they have no notch, they may have regions of less open area (i.e. more photoresist coverage) around the edge of the wafer that results in current crowding and reduced plating uniformity.

Many WLP wafers have a scribe region near the notch characterized by less open area. In processing these types of wafers, a seal with a smaller cross section at the notch allows the thief electrode to act preferentially at the scribe region, improving current flux uniformity. Where partial die are not patterned on the wafer (i.e. no dummy bumps), there may be varying regions of continuous photoresist around the wafer which can also be matched with an appropriate varying ring cross section to cause the thief electrode to act more or less strongly.

Figure 1:
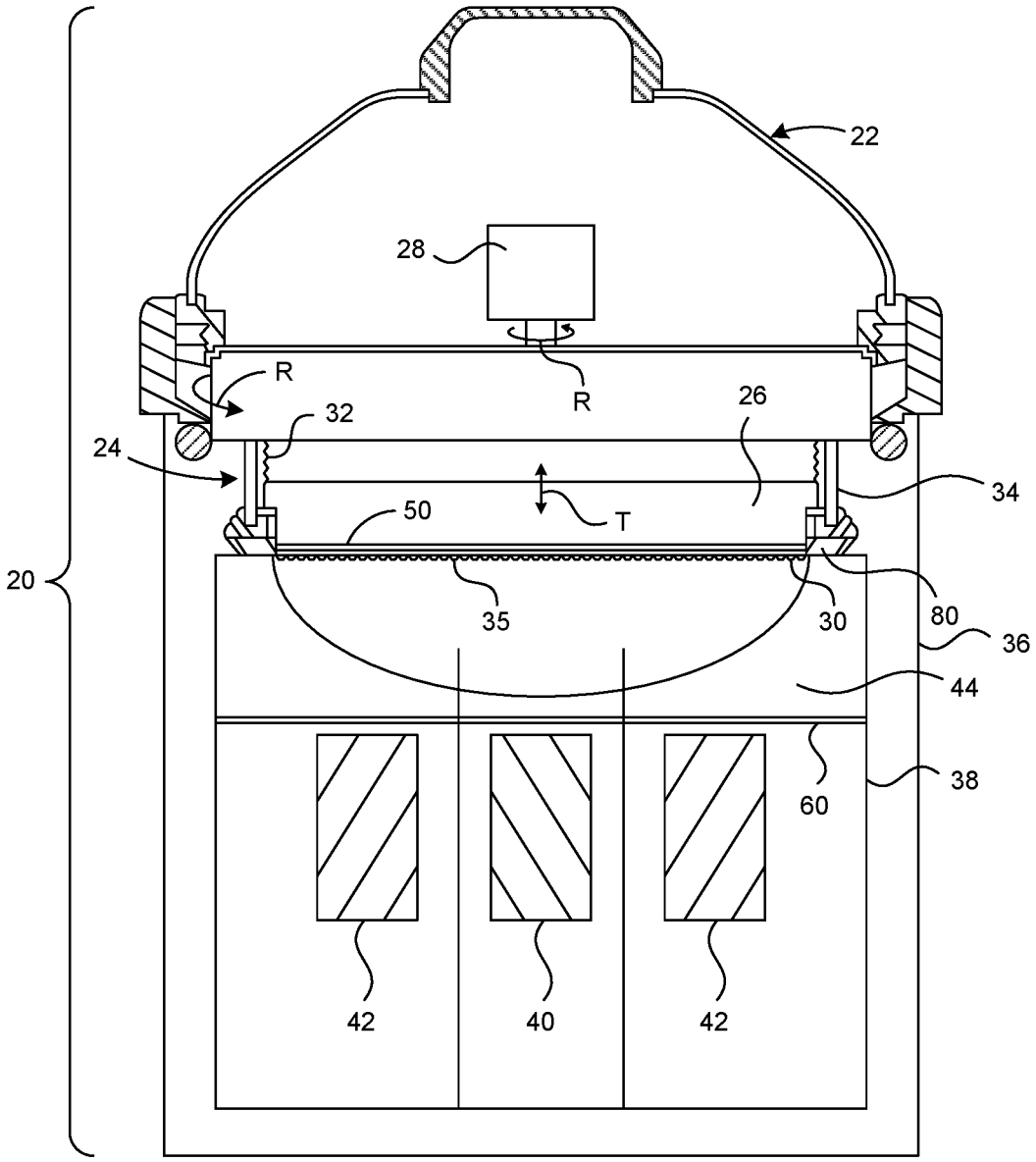
FIG. 1 (Prior Art)
FIG. 1 is a schematic drawing of an electroplating apparatus.

Turning now in detail to the drawing, as shown in FIG. 1, an electroplating apparatus 20 has a rotor 24 in a head 22. The rotor 24 includes a backing plate 26 and a contact ring 30 having a seal 80. Contact ring actuators 34 move the contact ring 30 vertically (in the direction T in FIG. 1), to engage the contact ring 30 and the seal 80 onto the down facing surface of a wafer or substrate 50. A bellows 32 may be used to seal internal components of the head.

The contact ring typically has metal fingers 35 that contact a conductive layer on the wafer 50. The head 22 is positioned to place the substrate 50 into a bath of liquid electrolyte held in a vessel 38 in a base 36. One or more electrodes are in contact with the liquid electrolyte. FIG. 1 shows a design having a center electrode 40 surrounded by a single outer electrode 42, although multiple concentric outer electrodes may be used. An electric field shaping unit 44 made of a di-electric material may be positioned in the vessel between the electrodes and the wafer.

A membrane 60 may optionally be included, with anolyte in a lower chamber below the membrane and with catholyte in an upper chamber above the membrane 60. Electric current passes from the electrodes through the electrolyte to a conductive surface on the wafer. A motor 28 in the head may be used to rotate the wafer during electroplating.

Figure 2:
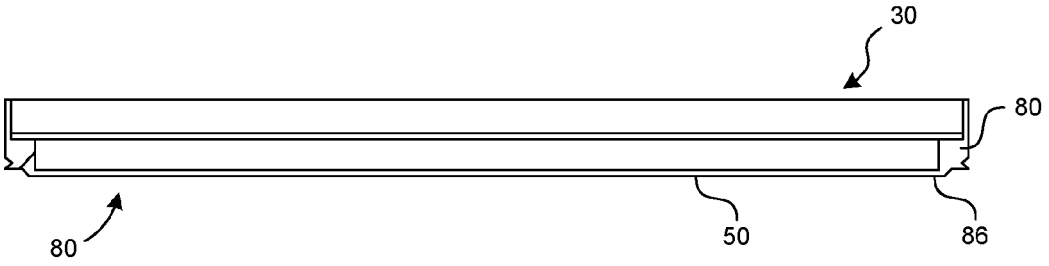
FIG. 2 (Prior Art)
FIG. 2 is a schematic drawing of the contact ring of the electroplating apparatus shown in FIG. 1.
Figure 3:
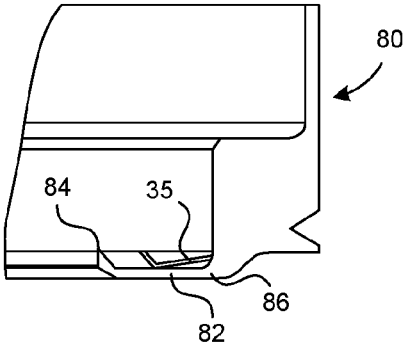
FIG. 3 (Prior Art)
FIG. 3 is an enlarged detail view of a section of the seal on the contact ring shown in FIG. 2.
Figure 4:
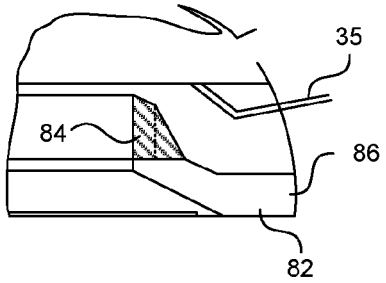
FIG. 4 (Prior Art)
FIG. 4 is a further enlarged detail view of tip of the seal of FIG. 3.

Turning to FIGS. 2-4, the seal 80 typically has an elastomer tip 84 which contacts and forms a seal against the wafer, with the tip 84 supported on, or part of, a rim 86 having a beam-like or cantilever structure. The contact fingers 35, which are typically flexible metal elements, touch the wafer to the outside of the seal, so that they are not exposed to the electrolyte. Conventional seals 80 generally have a uniform cross section around the entire circumference.

Figure 6:
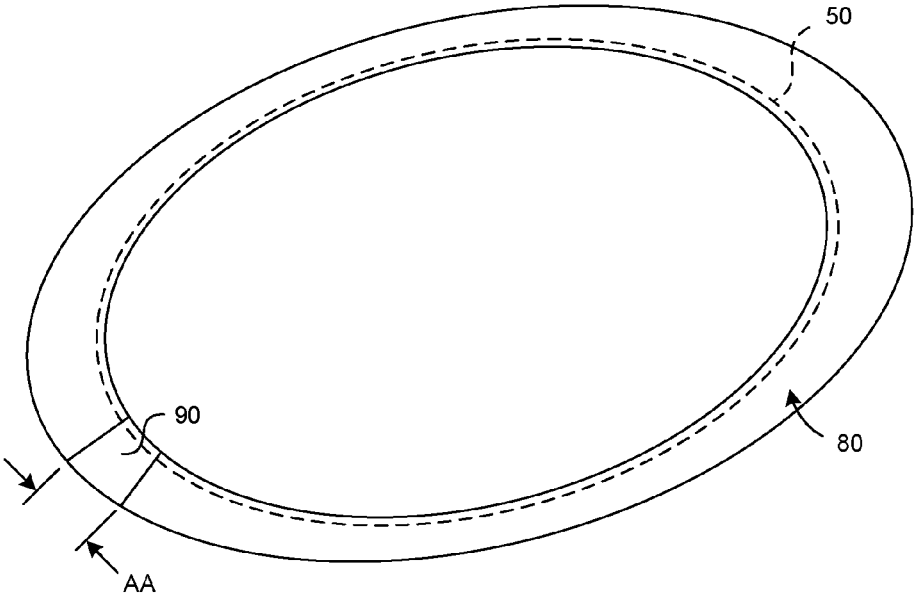
FIG. 6 is a perspective schematic view of the seal as shown in FIG. 2.

Referring now to FIG. 6, to compensate for current crowding at the notch 52, the present apparatus 20 may have a seal 80 having a thin section 90. In use, the wafer 50 is loaded into the apparatus 20 with the notch 52 aligned with the flat section 90. As the seal 80 rotates with the wafer 50 during processing, the flat section 90 remains aligned with the notch 52. For a 300 mm diameter wafer having an industry standard notch, the flat section may have a width AA of 25-33 mm, or 27-31 mm.

Figure 7:
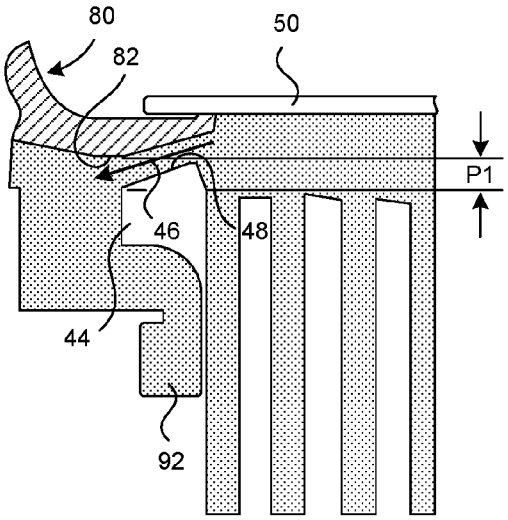
FIG. 7 is a schematic view of all sections of the seal in a processing position, except at the notch shown in FIG. 5.
Figure 8:
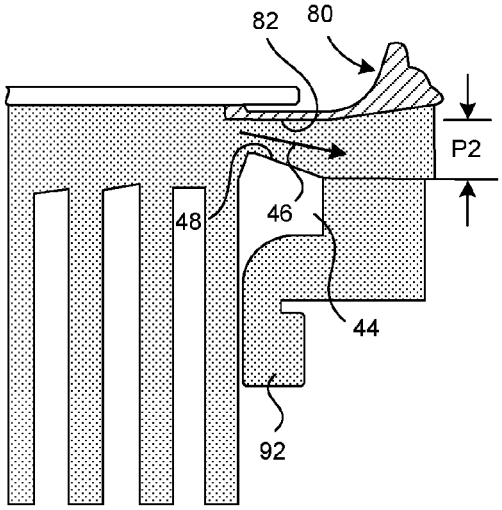
FIG. 8 is a schematic section view of the seal of FIGS. 6 and 7, at the notch.
Figure 9:
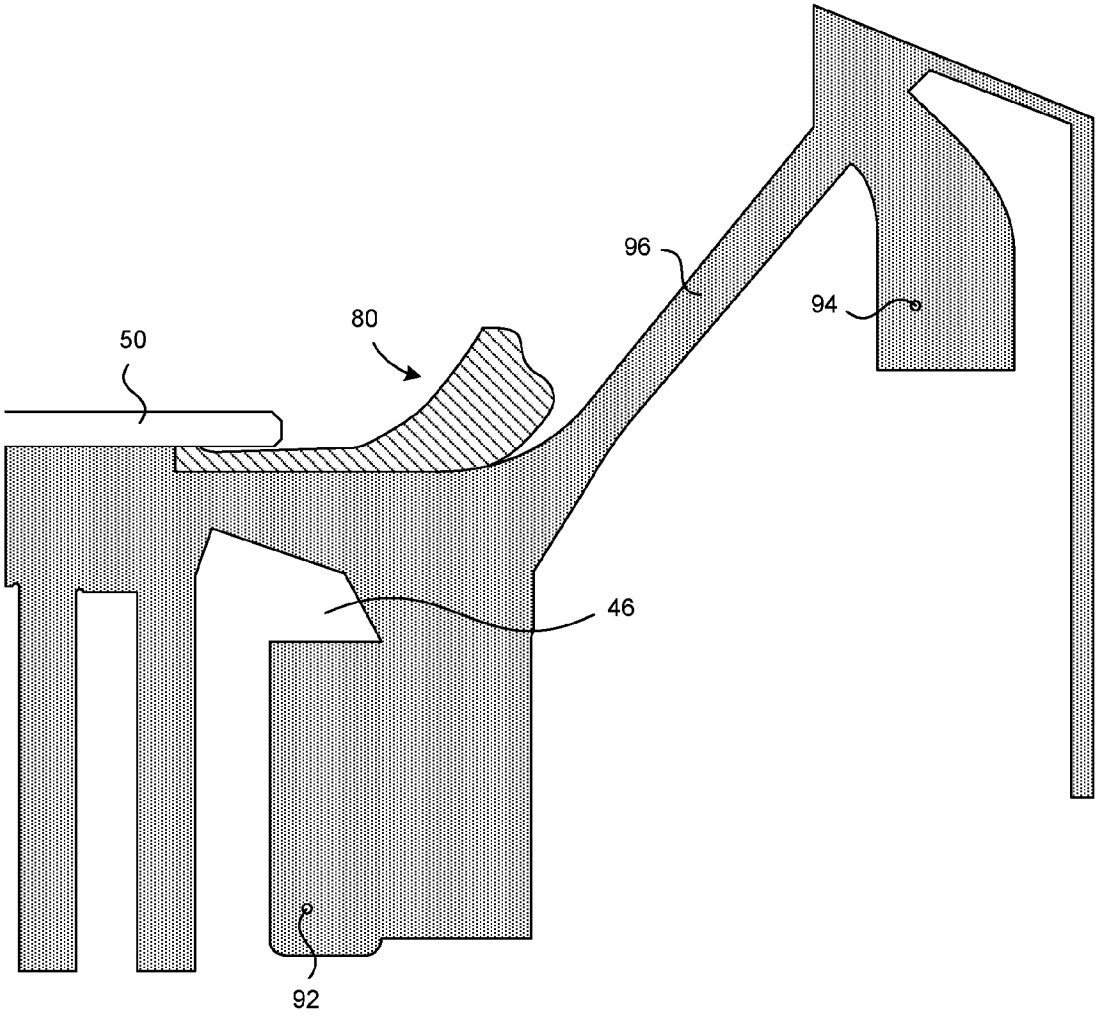
FIG. 9 is a schematic section view of an alternative embodiment.

In FIGS. 7-9, the gray areas represent liquid electrolyte 46 in the vessel 38. The white areas 44 represent the solid material of the field shaping unit 44. FIG. 7 shows a cross section of seal 80 around the entire circumference, except at the flat section 90. An electric current flow path through the electrolyte 46 with characteristic dimension P1 is formed between the bottom or down-facing surface 82 of the seal 80 and the top surface 48 of the field shaping unit 44.

FIG. 8 shows a cross section of the seal 80 at the flat section 90. At the flat section 90, the seal 80 does not project down as far as it does over the rest of the circumference of the seal 80. As a result, the electric current flow path through the electrolyte 46 at the flat section 90 has a characteristic dimension P2, which is 20-400% or 50-200% greater than P1. As the resistance of the P2 path is less than the P1, the thief electrode 92 exerts a stronger influence on the electric field at the notch 52, helping to compensate for the current crowding at the notch 52.

FIG. 9 shows an alternative design having an outer current flow path 96 leading to a second or outer electrode 94. Both electrodes 92 and 94 may be connected to thief channels drawing thieving current, or the electrode 94 may act as a current thief while electrode 92 acts an anode (with the contact fingers acting as a cathode). With electrode 92 acting as an additional anode and electrode 94 acting as a current thief, current flow through section 96 is increased, allowing for better compensation for wafer offset and notch correction. The cross section area and length of the section or space 96 (which is a volume of electrolyte) influences the amount of current drawn from the wafer edge to the thief electrode 94. The cross section area of the space 96 may be increased around the notch by providing a local recess in the contact ring (which rotates with the wafer so that the recess remains aligned with the notch during plating).

Figure 10:
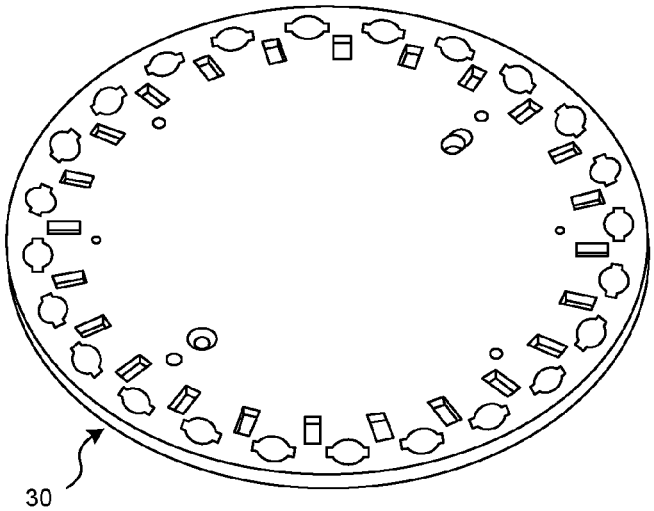
FIG. 10 is a perspective view of a contact ring.
Figure 11:
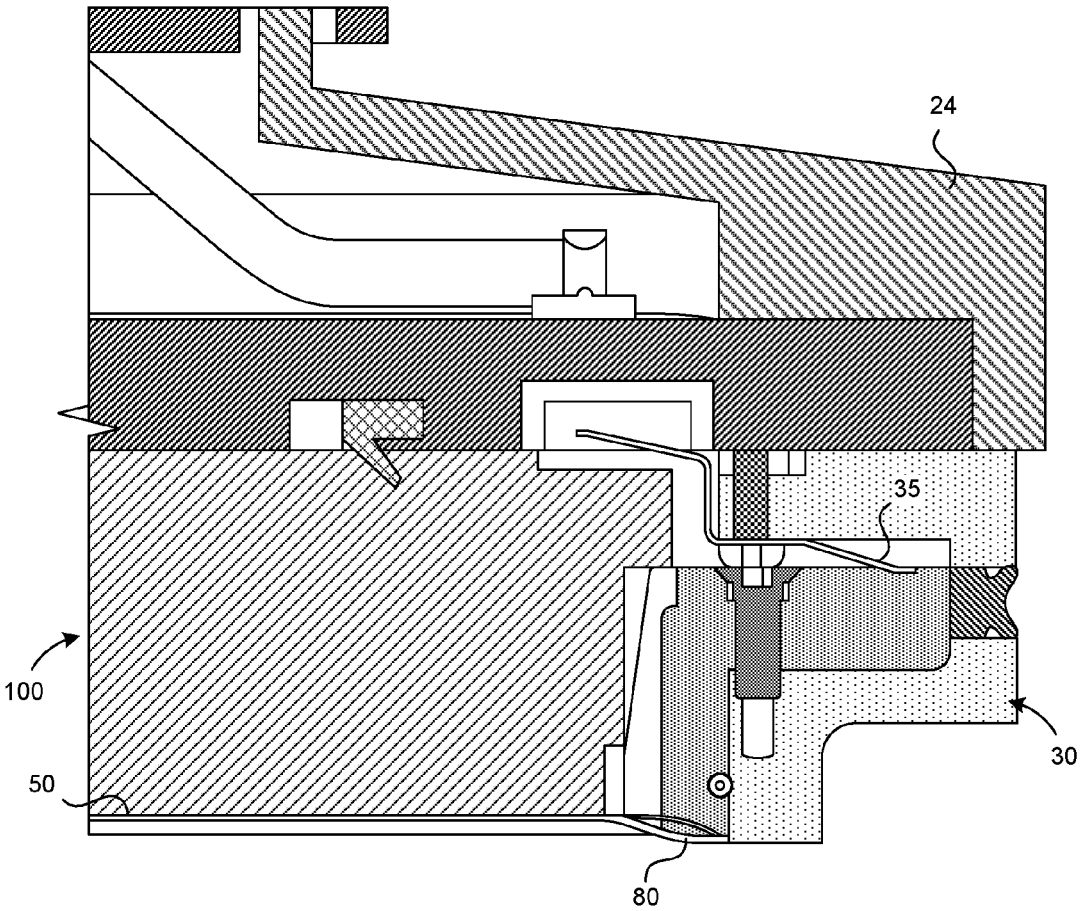
FIG. 11 is an enlarged detail section view of the electrical connection between the contact fingers on the ring contact to the chuck assembly and the rotor.
Figure 12:
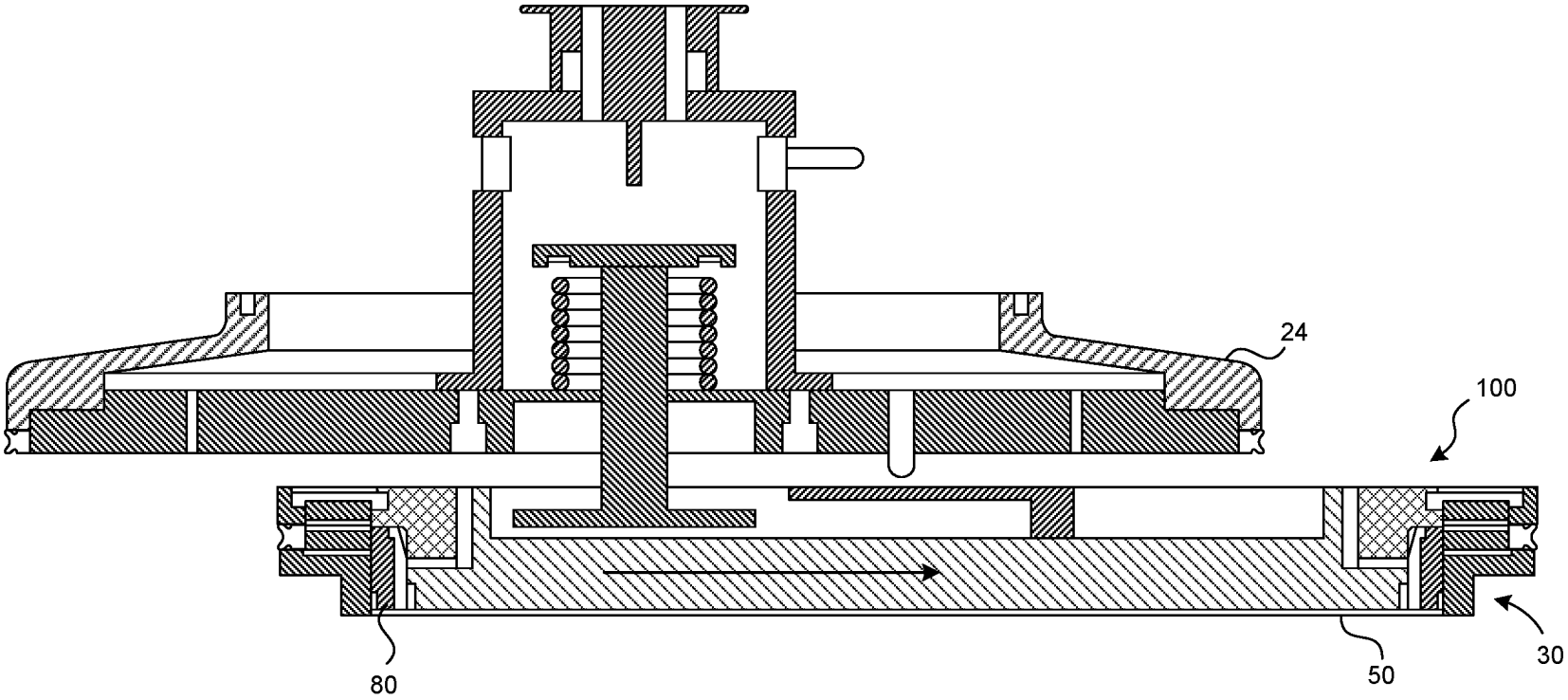
FIG. 12 is section view showing unclamping the chuck assembly of FIG. 11 from a rotor.

Turning now to FIGS. 10, 11 and 12, in certain newer wafer processing systems, the wafer is placed into a chuck 100 which includes a ring contact 30 with the seal 80. The chuck (with the wafer enclosed) travels through a processing system having an array of various apparatus or chambers to perform different processing steps. In this type of system, seals modified as discussed above may be matched to specific types of wafers. For example, the seal on one set of chucks for wafers may have reduced thickness regions near the scribe, and other chucks may have seals specially modified for use with wafers having dummy bumps. With this approach, no changes to the electroplating apparatus itself are needed to handle various wafers and their unique plating uniformity issues around the wafer circumference.

As used here, wafer means a substrate, for example a silicon wafer, on which microelectronic, micro-mechanical and/or micro-optical devices are formed. The techniques described above may similarly be used to reduce plating deviations caused by scribe regions.

Thus, novel apparatus and methods have been shown and described. Various changes and substitutions may of course be made, without departing from the spirit and scope of the invention. The invention, therefore, should not be limited except by the following claims and their equivalents.

The invention claimed is:

1. An electroplating method, comprising:

holding a wafer having an edge feature in a contact ring of an electroplating apparatus;

contacting the wafer with a seal having a uniform cross section, except at the edge feature where the seal has a reduced height segment;

placing at least one side of the wafer into contact with a plating solution and passing a first electric current of a first polarity through the plating solution, through a conductive film on the at least one side of the wafer, and through electrical contacts on the contact ring;

passing electric current of a second polarity through a thief electrode in contact with the plating solution, with the thief electrode drawing a fraction of the first current through the reduced height segment, to compensate for current crowding at the edge feature.

2. The method of claim 1 wherein the edge feature is a notch in the edge of the wafer.

3. A method for processing a wafer, comprising:

identifying at least one irregularity on the wafer;

placing the wafer into a chuck having a contact ring including a seal, with the contact ring and/or the seal having a change in shape adapted to reduce electric current crowding at the at least one irregularity;

moving the chuck into an electroplating apparatus; and electroplating the wafer while compensating for the irregularity by reducing current crowding at the irregularity via a thief electrode.

4. The method of claim 3 wherein the at least one irregularity is a notch in the edge of the wafer.

5. The method of claim 3 wherein the at least one irregularity is a scribe region on the wafer.

6. The method of claim 3 wherein the wafer has first and second irregularities, and the seal has first and second reduced height segments aligned with the first and second irregularities.

7. The method of claim 3 wherein the change in shape is a recess in the contact ring.

8. The method of claim 3 wherein the change in shape is a change in the shape of the contact ring at the irregularity which increases the exposure of the at least one irregularity to the thief electrode.

* * * * *